United States Patent [19]

Leder et al.

[11] 4,019,902

[45] Apr. 26, 1977

[54] PHOTORECEPTOR FABRICATION

[75] Inventors: Lewis B. Leder, Rochester; John C. Schottmiller, Penfield; Harold H. Schroeder, Rochester, all of N.Y.

[73] Assignee: Xerox Corporation, Stamford, Conn.

[22] Filed: Aug. 15, 1975

[21] Appl. No.: 605,136

Related U.S. Application Data

[63] Continuation-in-part of Ser. No. 477,736, June 10, 1974, abandoned.

[52] U.S. Cl. ..... 96/1.5; 427/34; 427/45; 204/192 R; 346/160

[51] Int. Cl.[2] ..... G03G 5/04

[58] Field of Search ..... 96/1.5; 427/34, 45; 204/192; 346/74 P

[56] References Cited

UNITED STATES PATENTS

| | | | |
|---|---|---|---|
| 2,636,855 | 4/1953 | Schwarz | 204/192 |
| 3,799,862 | 3/1974 | Krutenat | 204/298 |
| 3,816,288 | 6/1974 | Lubicz et al. | 96/1.5 |

*Primary Examiner*—J. Travis Brown
*Assistant Examiner*—Judson R. Hightower
*Attorney, Agent, or Firm*—James J. Ralabate; James P. O'Sullivan; John E. Crowe

[57] ABSTRACT

A durable photoreceptor having improved flexibility comprising a metal- or metal-coated flexible substrate and an inorganic photoconductor layer in charge blocking contact, the photoreceptor being obtained by initially bombarding the metal substrate, as cathode, with positive ions of an inert gas of low ionization potential under glow discharge in the presence of oxygen; and exposing the resulting oxide-coated substrate to a vapor cloud of photoconductor material consisting essentially of charged and uncharged material in an electrical field, utilizing the metal substrate as a cathode and a donor of said vapor cloud of photoconductor material or container thereof as an anode, the latter step being effected in combination with at least part of the initial bombardment step.

13 Claims, No Drawings

PHOTORECEPTOR FABRICATION

BACKGROUND OF THE INVENTION

This invention is a continuation-in-part of Ser. No. 477,736, filed on June 10, 1974 now abandoned and entitled "Improved Photoreceptor Fabrication", and relates to improved photoreceptors utilizing flexible substrates and relatively brittle heavy ionizable inorganic photoconductive material, the photoreceptor being obtained in accordance with a two-step oxidation-ion-deposition process.

Photoreceptors, particularly those related to xerographic copying, traditionally comprise a photoconductive insulating layer such as an ionizable element or alloy thereof exemplified by selenium (amorphous or trigonal) and selenium alloys such as a selenium-arsenic alloy with varying amounts of a halogen. Such materials are customarily applied in charge blocking contact to a supporting metal- or metal-covered charge-conductive substrate. Suitable substrates for such purpose include, for instance, aluminum, steel, nickel, brass, NESA glass or corresponding metal-coated polymeric materials.

Photoreceptors comprising at least the above elements are generally given a uniform electrostatic charge and the sensitized surface then exposed to an image pattern defined by an electromagnetic radiation, such as light. Light impingement results in a selective dissipation of the initially applied charge leaving a positive electrostatic image. The electrostatic image is then customarily developed by applying oppositely charged electroscopic marking particles onto the charge-bearing photoreceptor surface.

The above basic concept was originally described by Carlson in U.S. Pat. No. 2,297,691, and has been since amplified and redescribed in many related patents in the field. Generally speaking, however, photoconductive layers suitable for carrying out the above functions have a specific resistivity of about $10^{10} - 10^{13}$ ohm-cm, in the absence of illumination. In addition, their resistivity must drop at least several orders of magnitude where exposed to an activating radiation such as light.

Photoconductive layers meeting the above criteria also normally exhibit some loss in applied charge, even in the absence of light exposure. This phenomenon is known as "dark decay" and will vary somewhat with sensitivity and with usage of the photoreceptor. The existence of the problem of "dark decay" is well known and has been controlled to a substantial extent by incorporation of thin barrier layers such as a dielectric film between the base or substrate and the photoconductive insulating layer. U.S. Pat. No. 2,901,348 of Dessauer et al utilizes a film of aluminum oxide of about 25 to 200 angstrom or an insulating resin layer, such as a polystyrene of about 0.1 to 2 microns thickness for such purpose. With some limitations, these barrier layers function to allow the photoconductive layer to support a charge of high field strength while minimizing "dark decay". When activated by illumination, however, the photoconductive layer and barrier layer must become sufficiently conductive to permit substantial dissipation of the applied charge in light-struck areas within a short period of time.

In addition to the above-indicated electrical requirements, it is also becoming increasingly important that photoreceptors meet rather stringent requirements with regard to mechanical properties such as flexibility and durability. Such additional criteria become particularly important in modern automatic copiers operating at high speeds where the photoreceptor is in the form of an endless flexible belt (ref. U.S. Pat. No. 2,691,450). While belt-type photoreceptors have many advantages, there are also serious technical problems inherent in their use. For example, high speed machine cycling conditions require particularly strong adhesion between the photoconductive layer and the underlying substrate. Unfortunately, however, some of the most sensitive and efficient photoconductive materials are relatively brittle as films and do not generally adhere well to flexing metal substrates having a good charge blocking contact. It is very important, however, that any charge blocking interface between the electrically conductive supporting substrate and the photoconductive layer be stable and strongly adherent to both since changes at this point will have a substantial effect on the electrical properties and lifetime of the photoreceptor.

It is an object of the present invention to obtain improved photoreceptors suitable for high speed xerographic copying purposes.

It is a further object of the present invention to develop a new method for utilizing brittle photoconductive elements in high speed flexible photoreceptors without the need for complicated chemical pre-treatment of the substrate.

THE INVENTION

These and other objects of the instant invention are achieved in obtaining flexible photoreceptors having improved durability and adhesion between components thereof and containing a metal- or metal-coated substrate and a photoconductive layer of an ionizable inorganic photoconductive material in good charge blocking contact with the substrate by initially bombarding the substrate, as cathode under partial vaccum, with positive ions of a non-metallic gas under glow discharge in the presence of air, or a mixture of oxygen with at least one inert ion-forming gas. Such gases include argon, xenon, etc.; exposing the resulting oxidized substrate to a vapor cloud of photoconductive material consisting essentially of both charged and uncharged photoconductive particles in and adjacent to an electrical field, utilizing a donor of said photoconductive material or container thereof or adjacent structure and the substrate as an electrode, the exposure of the oxidized substrate being effected separately or in conjunction with at least part of the initial substrate bombardment step.

Suitable substrates for purposes of the present invention usefully consist of relatively thin metal foils of copper, steel, brass, aluminum, zinc, nickel, or a corresponding metal-coated flexible polymeric base such as a coated polyethylene terephthalate. Of particular interest as substrates are aluminum-coated polyethylene terephthalate belts and nickel belts.

Photoconductive materials suitable for use in the instant process are generally inorganic ionizable elements, such as selenium, selenium alloys inclusive of alloys of selenium with tellurium, germanium, antimony, bismuth and arsenic and/or one or more halogens such as chlorine, bromine, or iodine. Such photoconductive materials are obtainable, for instance, by subjecting selenium plus small amounts of arsenic, etc., and halogen to heat.

For purposes of the present invention, the substrate includes at least one thin oxide layer as a charge blocking layer in general accordance with U.S. Pat. No. 2,901,348, or otherwise as suggested above. When flexible metal belts such as nickel belts are used, however, special chemical treatment has hitherto been required in order to obtain adhesion of the photoconductive layer to the substrate and intermediate blocking layers.

Satisfactory adhesion of brittle inorganic photoconductor material such as above defined, to flexible metal substrates can now be satisfactorily accomplished more easily and with better results in accordance with the present invention.

The initial bombardment of the substrate as a cathode, with positive ions of a non-metallic gas is best carried out, for instance, by evacuating a suitably modified vacuum coater down to a pressure of about $5 \times 10^{-5}$ Torr or better and then backfilling with up to about 5 – 30 microns (mercury) of air. A pressure of about 10 – 15 microns is generally preferred. While air under reduced pressure is acceptable, it is also found convenient to utilize various alternative mixtures of positive-ion-producing and oxidizing gases at comparable pressures. Such include, for instance, argon-oxygen, argon-air, argon-$C0_2$, or a mixture of pure nitrogen and oxygen, etc., provided the amount of available oxygen for initial oxidation of the substrate is not less than about 1% by volume of the gases utilized, and provided a glow discharge can be maintained.

In accordance with the present invention it is also found that initial ion bombardment of the substrate is preferably effected under glow discharge at a potential ranging from about 1500 to about 3500 volts and a current density of about 0.05 – 0.5 ma/cm$^2$, depending upon the type and pressure of gas used to form the positive ions.

After completion of glow discharge sufficient to ion clean the substrate, form an oxide barrier layer of about 10 – 200 angstrom thickness, and heat the substrate to a temperature of about 55° C. – 80° C. (about 5 – 20 minutes and preferably 8 – 10 minutes under the conditions indicated above), the heated oxidized substrate (cathode) is simultaneously exposed to a cloud of charged and uncharged photoconductive particles evolved from a heated photoconductor source in and adjacent to a region of glow discharge. In such situation, the simultaneous overlapping substrate bombardment by positive non-metallic ions such as argon or nitrogen will have a tendency to displace more loosely adherent condensed photoconductive particles laid down on the substrate in their unionized state, thus favoring the formation of a layer of initially charged photoconductive particles having greater original velocity and energy content. This occurs despite the relatively low concentration of photoconductive ions obtained under glow discharge relative to the total amount of thermally created photoconductive particles.

For purposes of the present invention, deposition on the oxidized substrate is best effected by separately heating a photoconductor source to a temperature between room temperature and the maximum evaporation temperature of the photoconductive material. For such purpose, the preferred temperature range (1) favors maximum vapor concentration and field conditions commensurate with maintenance of a glow discharge proximate to a heated photoconductor source (anode) and a substrate (cathode) and (2) favors the highest possible conversion of uncharged to charged photoconductive particles to effect the impaction of the largest possible concentration of high energy photoconductive particles onto the substrate.

In view of the above-described displacement of loosely adherent low energy photoconductive materials from the substrate by bombardment with gaseous ions (i.e. nitrogen or argon, etc.) during the second phase of the described inventive process, it is also important that an adequate concentration of such ions be maintained along with charged photoconductive particles.

As a practical matter, this can be conveniently accomplished, when it is desired not to use an oxygen containing gas, by increasing the amount of vacuum and then backfilling the coating chamber up to about 5 – 30 microns pressure of argon, nitrogen, xenon or similar relatively inert gases.

In order to effectively raise the vapor pressure of the photoconductive material for deposit onto the oxidized substrate, the photoconductor source is conveniently heated by a number of different ways. Such include, for instance, resistance heating of a crucible containing the photoconductive material, the use of an electron beam or gun directed at the contents of the photoconductive source, or even by ion beam heating of the photoconductive material. In any case, the optimum temperatures will vary with the photoconductive material, the distance between source and substrate, and the atmospheric composition and pressure utilized. By way of example, a (crucible) temperature up to about 350° C. and preferably about 180° C. – 350° C. is found adequate for vaporizing selenium and most of the known selenium alloys under a pressure up to about 30 microns.

During the period of photoconductor deposition onto the clean oxide-coated substrate, it is essential that a glow discharge be maintained for purposes of creating PC ions but without seriously limiting the rate and area of deposition of the photoconductive material onto the substrate.

The relationship of the electrodes and other essential components of the above-described two major phases of the inventive process are very generally represented in modified form in Diagrams IA and IB as follows:

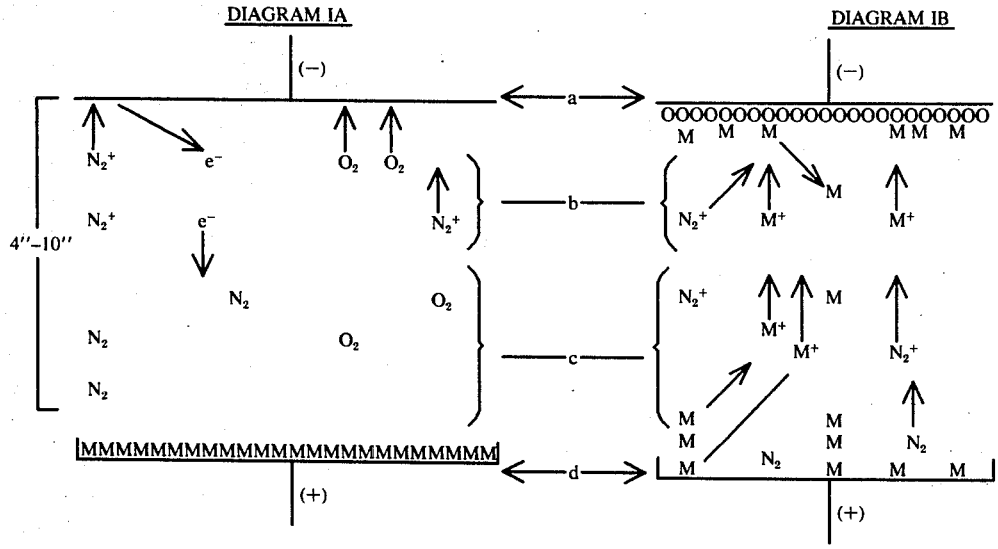
DIAGRAM IA
DIAGRAM IB
(−)
(+)
a
b
c
d
4"–10"
$N_2^+$
$e^-$
$O_2$
$N_2$
M
$M^+$
MMMM least about 0.01$\mu$ thickness is sufficient but not limiting, with the balance of deposition optionally completed by convention vacuum deposition techniques at about $5 \times 10^{-5}$ Torr. If desired, however, the entire photoconductive layer may be deposited in the mode above described.

The following examples specifically demonstrate preferred embodiments of the present invention without limiting it thereby.

EXAMPLE I

A nickel alloy test belt identified as A-1 and having a thickness of 4.5 mil (0.0045 inches), a length of 10 inches and a circumference of 15 inches, is cleaned with a hot aqueous solution containing 10% by weight of "Mitchell Bradford No. 14 Cleaner" and rinsed in deionized water for about 2 minutes.

Sample belt A-1 is mounted on a rotatable mandrel insulated from ground in a vacuum coater about 6 inches away from 3 stainless steel crucibles equipped with resistive heating means and containing a photoconductive selenium alloy consisting of about 99.5% selenium and 0.5% arsenic. After evacuating the coater to $5 \times 10^{-5}$ Torr and backfilling with about 10 $\mu$ air pressure, a glow discharge is formed in a 3000 v electrical field to a cathode current density of 0.1 ma/cm$^2$, using the rotating metal belt substrate as cathode and the photoconductive alloy-containing stainless steel crucible as anode. After 8 minutes under glow discharge the steel crucibles are heated up to about 280° C. and maintained for about 25 minutes. During this period the belt is constantly rotated at about 10 revolutions per minute to obtain a uniform photoconductive layer of about 50$\mu$. The belt is then returned to room ambient conditions and tested for electrical properties and flex. The results are reported in Table I infra.

EXAMPLE II

Two nickel test belts of essentially identical size and shape as test belt A-1, and identified as A-2 and A-3 are cleaned as in Example I and coated as follows:

Belt A-2 is coated as in Example I except that a 15 $\mu$ backfill of oxygen (5% by volume) and argon (95% by volume) is utilized in place of air during the initial oxide coating, cleaning and heating step. The electrical field is initially operated at 2500 volts and 0.05 ma/cm$^2$. After 14 minutes, the oxygen flow is stopped while the argon flow is increased to maintain a 15 $\mu$ pressure. The steel crucibles are heated up to about 250° C. for 2.5 minutes. Thereafter, the glow discharge is discontinued by cutting off the field and argon flow and regular vacuum deposition continued at 280° C. and $5 \times 10^{-5}$ Torr for a time sufficient to obtain a 50 $\mu$ thickness of PC. The resulting coated belt is tested as in Example I and the results reported in Table I infra.

Belt A-3 (control) is treated identically as A-1 in Example I except that the glow discharge is terminated and a coater pressure of $5 \times 10^{-5}$ Torr is instituted after forming the oxide layer and before heating up some of the phtoconductive material. After vacuum deposition for a time sufficient to obtain a 50 micron coating, cooled and tested as in Example I.

EXAMPLE III

A test belt identical with A-1 through A-3 of Examples I-II and identified as belt A-4 is treated identically as belt A-1 of Example I except that no chemical cleaning or washing step other than degreasing is undertaken prior to the initial ion bombardment of the substrate in an oxygen-containing glow discharge with positive ions to lay down an oxide layer. The coated belt is tested and reported in Table I.

TABLE I

| Test Belt | Capacitive Charge (v/u) | 20 Second Dark Decay v/sec | Mandrel Test* (1½" Diameter) |
|---|---|---|---|
| A-1 | 21 | 15 | P |
| A-2 | 27 | 12 | P |
| A-3 | 23 | 15 | F |
| A-4 | 25 | 18 | P |

*P = pass (no cracks or spalls observed)
F = fail (one or more cracks or spalls observed)
Belt bent once around a 1½" pipe at room temperature.

EXAMPLE IV

Example I is repeated utilizing a stainless steel, an aluminum and brass test belts of the same dimensions as belt A-1 and comparable test results are obtained.

While the above Examples are directed to preferred embodiments of the invention, it will be understood that the invention is not limited thereby.

What is claimed is:

1. A method for obtaining flexible photoreceptors having improved durability and adhesion between components thereof and containing a metal- or metal-coated substrate and a photoconductive layer of an ionizable inorganic photoconductive material in good charge blocking contact with the substrate, comprising initially bombarding the substrate, as cathode, under partial vacuum, with positive ions of a non-metallic gas under glow discharge in the presence of air or a mixture of oxygen with at least one inert ion-forming gas; and exposing the resulting oxidized substrate to a vapor cloud of photoconductive material consisting essentially of both charged and uncharged photoconductive particles in and adjacent to an electrical field utilizing a donor of said photoconductive material or container thereof or adjacent structure and the substrate as an electrode, the exposure of the oxidized substrate being effected separately or in conjunction with at least part of the initial substrate bombardment step.

2. The method of claim 1 wherein initial positive ion bombardment of the substrate is effected at a pressure of about $5 \times 10^{-5}$ Torr backfilled with up to about 5 – 30 microns (mercury) of air, the amount of available oxygen for initial oxidation of the substrate being not less than about 1% by volume of the gases utilized.

3. The method of claim 1 wherein exposure of the oxidized substrate to the vapor cloud of photoconductive material is effected by heating the photoconductive material to a temperature between room temperature and the maximum evaporation temperature of the photoconductive material, utilizing the substrate as a cathode and the photoconductive material or container thereof as an anode under glow discharge.

4. The method of claim 2 wherein the initial positive ion bombardment of the substrate is effected under an oxygen-containing atmosphere at a pressure of about 10 – 15 microns (mercury).

5. The method of claim 3 wherein the photoconductive material is heated by at least one of electron bombardment, by ion bombardment or by a resistance heating means.

6. The method of claim 1 wherein the substrate is a charge conductive metal belt and the ionizable inorganic photoconductive material comprises selenium or a selenium alloy.

7. The method of claim 6 wherein the substrate is a charge conductive metal belt and the ionizable inorganic photoconductive material comprises a selenium-arsenic-halogen alloy.

8. The method of claim 2 wherein additional photoconductive material is subsequently applied to the oxidized substrate by vapor deposition.

9. The method of claim 6 wherein additional photoconductive material is subsequently applied to the substrate by vapor deposition.

10. The method of claim 8 wherein photoconductive material is deposited on the oxide-coated substrate under glow discharge to a thickness of at least about $0.01\mu$, the balance being deposited by vapor deposition.

11. A flexible photoreceptor comprising a metal- or metal-coated substrate and a photoconductive layer of a heavy ionizable inorganic photoconductive material in good charge blocking contact with the substrate, obtained in accordance with the method of claim 1.

12. A flexible photoreceptor comprising a metal- or metal-coated substrate and a photoconductive layer of a heavy ionizable inorganic photoconductive material in good charge blocking contact with the substrate obtained in accordance with the method of claim 9.

13. A flexible photoreceptor comprising a metal- or metal-coated substrate and a photoconductive layer of a heavy ionizable inorganic photoconductive material in good charge blocking contact with the substrate obtained in accordance with the method of claim 10.

* * * * *